United States Patent [19]

Fidi et al.

[11] 4,367,544

[45] Jan. 4, 1983

[54] ELECTROMAGNETIC TRANSDUCERS FOR CONVERTING MECHANICALLY ACOUSTIC EVENTS INTO ALTERNATING VOLTAGES

[75] Inventors: Werner Fidi, Baden; Richard Pribyl, Vienna, both of Austria

[73] Assignee: AKG Akustische u Kino-Geräte Gesellschaft mbH, Austria

[21] Appl. No.: 148,671

[22] Filed: May 12, 1980

[30] Foreign Application Priority Data

May 14, 1979 [AT] Austria ..... 3541/79
Feb. 21, 1980 [AT] Austria ..... 969/80

[51] Int. Cl.[3] ..... H04R 11/12
[52] U.S. Cl. ..... 369/136; 369/149
[58] Field of Search ..... 369/136, 139, 146, 148–149

[56] References Cited

U.S. PATENT DOCUMENTS

| | | | |
|---|---|---|---|
| Re. 29,252 | 5/1977 | Anneberg et al. . | |
| 3,441,688 | 4/1969 | Shaper | 369/136 |
| 4,103,117 | 7/1978 | Moninaga | 369/146 |
| 4,124,782 | 11/1978 | Schon | 369/149 |
| 4,161,631 | 7/1979 | Matsuda | 369/139 |

FOREIGN PATENT DOCUMENTS

| | | |
|---|---|---|
| 1078340 | 3/1960 | Fed. Rep. of Germany . |
| 2007469 | 10/1970 | Fed. Rep. of Germany . |
| 2115122 | 10/1972 | Fed. Rep. of Germany . |
| 2132127 | 1/1972 | Fed. Rep. of Germany . |
| 2633722 | 2/1977 | Fed. Rep. of Germany . |
| 1318665 | 5/1973 | United Kingdom . |

*Primary Examiner*—Raymond F. Cardillo, Jr.
*Attorney, Agent, or Firm*—McGlew and Tuttle

[57] ABSTRACT

An electromagnetic transducer for converting mechanical or recorded acoustic events into alternating voltages particularly for tracing stereo signals recorded on plate shaped supports comprises a substantially cylindrical permanent magnet which is radially magnetized and disposed around four pole rods each of which has a coil winding therearound and whose axes are arranged substantially at corner points of a square in a plane perpendicular to the axes of the rods. A pickup stylus has a soft iron element which is driven by the stylus and which is disposed adjacent one end of the pole rods. The stylus is mounted for swinging movement about its center point, on the central axis of the transducer system. The soft iron element is directly included in the magnetic circuit at one end of the permanent magnet.

9 Claims, 8 Drawing Figures

ELECTROMAGNETIC TRANSDUCERS FOR CONVERTING MECHANICALLY ACOUSTIC EVENTS INTO ALTERNATING VOLTAGES

FIELD AND BACKGROUND OF THE INVENTION

This invention relates in general to electromagnetic transducers and in particular to a new and useful electromagnetic transducer for converting mechanically recorded acoustic events into alternating voltages particularly for tracing stereo signals recorded on plate shaped supports. The transducer of the invention includes a substantially cylindrical radially magnetized permanent magnet arranged around four pole rods which are disposed with their ends adjacent a soft iron piece connected to a pivotally mounted stylus.

Prior art transducer systems are provided with an easily magnetizable (soft) iron shell and a usually disc-shaped permanent magnet disposed at one end thereof. At the other end of the soft iron shell, an air gap is provided between the pole rods and a soft iron element which is usually designed as a small tube and driven by the pickup stylus. To minimize signal distortion, the soft iron tube is magnetized to, or close to, the saturation point. The windings provided on the pole rods serve to convert the magnetic flux, which varies in accordance with the recorded acoustic event, to proportional voltages. The advantage of such a transducer system is the small mass to be moved, including the stylus, its support, and the soft iron tube. In the prior art, the large number of individual parts needed and the laborious assembly resulting therefrom are disadvantages which make the manufacture of such systems relatively expensive. Another disadvantage is the necessity of magnetizing the soft iron tube carried on the stylus support to the range of saturation, to minimize distortion. This calls for a permanent magnet having a certain minimum mass and thus dimensions which make it rather difficult to incorporate the magnet in conventional constructions. A further disadvantage is that, in the area of the soft iron element which is driven by the stylus through the support thereof, only a relatively small stray flux occurs between the pole rods and the soft iron tube, with the result that most frequently the soft iron tube cannot be magnetized to the saturation point and some allowance must be made for distortion which depends on the degree of saturation. To obtain the necessary sensitivity in the prior art system, windings with a great number of turns are needed on the pole rods. This results in a high internal inductance of the windings and in a disadvantage that if such pickups are connected to an amplifier, through cables having a higher capacitance, resonance peaks are produced causing inadmissible sound distortions in the audible range.

A transducer is also known in which a soft iron tube is disposed within an annular permanent magnet which is magnetized in the axial direction. This arrangement requires a pole plate for supporting the pole rods and for conducting the magnetic flux from the permanent magnet to the pole rods. Since, in this design, the soft iron element is located in the area of the front ends of the pole rods, magnetic saturation of the soft iron tube can be attained in practice, however, additional flux conducting elements are needed which complicate the design of such prior art system. Since, due to its axial magnetization, the permanent magnet is effective as if it were disposed at one end of the pole rods, no compensation of uni-directional fields can be provided, and the pole rods are subjected to a considerable bias magnetization. Also, the dimensions of the permanent magnet remain limited, which requires windings with a great number of turns on the pole rods. The drawbacks connected thereto have already been mentioned above.

SUMMARY OF THE INVENTION

The invention is directed to an electromagnetic transducer in which such disadvantages of the prior art are avoided and which is constructed with a minimum of component parts.

In accordance with the invention the stylus is pivotally mounted for undulating movement about the axis of a magnetic system which includes four pole rods each of which has a winding therearound arranged in positions such that their axes are at the corners of a square. The stylus carries a soft iron piece which is disposed adjacent one of the common ends of the pole pieces and the pole pieces are surrounded by a substantially cylindrical permanent magnet which may be made up of one or more circumferentially arranged magnetic pieces.

The inventive arrangement has the substantial advantage that two magnetic fluxes, which are produced in the pole rods within the tubular permanent magnet or its bar elements, compensate each other so that a magnetization of the soft iron element, which is usually designed as a small tube, to the saturation range is ensured. In prior art constructions, this is possible only with difficulty, as already mentioned, since, due to the arrangement of the permanent magnet at one end of the pole rods, a substantially higher magnetic induction is necessary to produce a flux at the other end of the pole rods which would be sufficient for magnetizing the soft iron element. Also, the pole rods of prior art arrangements must be thicker than those of the invention, since otherwise they would be magnetized to saturation before reaching the induction wanted for the movable soft iron element. Further, in the inventive design, due to the tubular configuration of the permanent magnet or parts thereof, a higher induction can be attained than with the relatively small magnetizable blocks of conventional systems. For these reasons, the inventive design of an electromagnetic transducer ensures a higher sensitivity and a reduced distortion as compared to the prior art systems, since with only a small stray flux through the pole rods, a high effective magnetic flux in the soft iron tube is obtained. The design of the permanent magnet as a tube or magnetized bars in circular arrangement, and the geometry of the inventive system connected thereto, result in such a concentration of the magnetic flux in the area of the soft iron element that the magnetic saturation of this element can be ensured with a smaller magnetizable mass than before. Due to the high sensitivity of the inventive transducer, a smaller number of turns can be provided in the windings of the pole rods. This leads to the advantage that, because of lower internal inductance of the windings, longer cables or higher cable capacitances may be tolerated between the transducer and an amplifier. Finally, a tubular permanent magnet may be made from a ferritic material which is substantially less expensive than other magnetic materials and, in addition, can be formed into any shape. To further reduce the manufacturing costs and to avoid the somewhat expensive radial magnetization of a tubular piece, preferably bar-shaped parts of identical properties may be substituted for such a tubular permanent magnet.

These parts or elements are arranged to form cylindrical or square cross sectional shapes.

The individual elements can be magnetized in a substantially simpler and more satisfactory way than a ferromagnetic body in the form of a tube. The better magnetizability of the individual elements further result in a higher field strength and, consequently, in a higher sensitivity. If the shape of tube segments is given to the individual elements, they may be assembled, after magnetization to form a tubular permanent magnet, for example, by cementing them together. However, due to the high field intensity and the high energy product of new magnetic materials, it is not necessary to design the permanent magnet as a closed cylindrical tube. It may be assembled of individual, bar-shaped, elongated individual elements having a rectangular cross section, for example, which are arranged relative to each other and to the axis of the system as a quasicylindrical shell. In view of the outstanding properties of modern magnetic materials, relatively large intermediate spaces may be left between the individual bars, so that the inventive purpose may be served with only four bars. These four bars, each associated with one pole rod, may in practice occupy any position relative to the associated pole rod, as long as the longitudinal axes of both these elements are parallel to each other. This gives the designer of such a transducer a large scope of choice in the specific arrangement of the individual parts. If the individual elements are shaped like tube segments, two opposite elements, each facing a respective pair of pole rods, satisfy the requirement of producing the necessary magnetic field.

Accordingly, it is an object of the invention to provide an electromagnetic transducer for converting mechanically recorded acoustic events into alternating voltages, particularly for tracing stereo signals recorded on plate shaped supports which comprises four pole rods each having a coil winding therearound and having axes arranged substantially at corner points of a square in a plane perpendicular to the axes of the pole rods and which includes means defining a substantially cylindrical radially magnetized permanent magnet around all of the pole rods so as to define a transistor system which is coaxial with the pole rods and including a stylus which is mounted for pivotal movement adjacent one end of the pole rods and which has a soft iron piece or soft iron tubular element which is located directly in the magnetic circuit at one end of the permanent magnet.

A further object of the invention is to provide an electromagnetic transducer which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
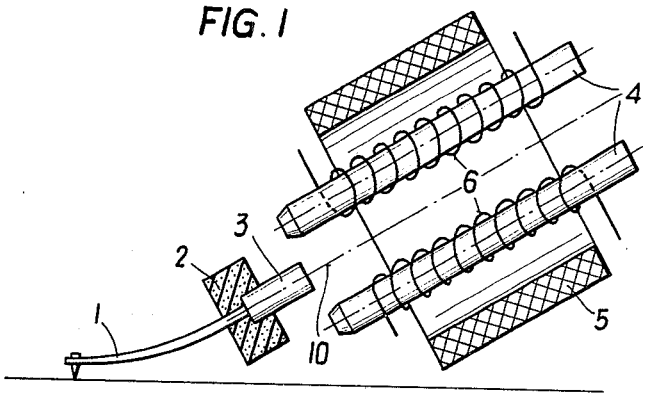
FIG. 1 is a partial diagrammatical sectional view of an embodiment of the invention.

Referring to the drawings in particular, the invention embodied therein, comprises an electromagnetic transducer for converting mechanically recorded acoustic events into alternating voltages, particularly for tracing stereo signals recorded on a plate shaped support and using a stylus or needle support 1 which is mounted in suitable means including a resilient bearing element 2 for universal pivotal movement of the needle support about a system axis 10 which is arranged centrally in respect to pole rods 4. Each rod 4 has a winding 6 therearound and all the rods are arranged within means defining a substantially cylindrical permanent magnet 5 which is radially magnetized.

Figure 4:
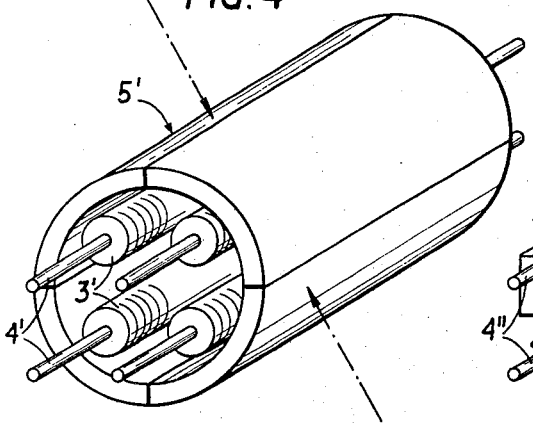
FIG. 4 shows an embodiment with a permanent magnet assembled of tube segments.
Figure 6:
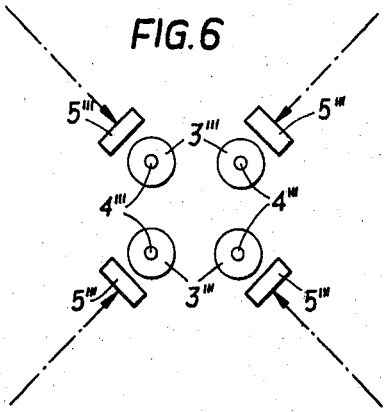
FIG. 6 diagrammatically shows an embodiment with four magnetic bars.
Figure 8:
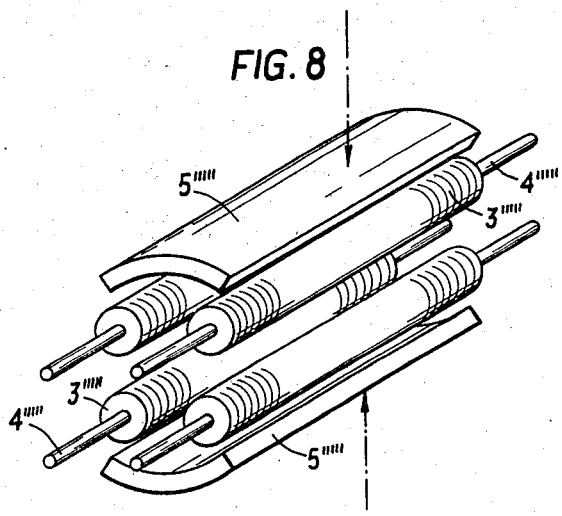
FIG. 8 shows an embodiment with two opposite elements in the shape of two tube segments.

In FIGS. 4, 6 and 8, the magnetic field directions are indicated by dash-dotted arrows.

FIG. 1 shows a stylus or needle support 1 which is mounted for swinging in a resilient bearing element 2 and carries on its free end a soft iron element 3 in the form of a small tube. The iron element 3 is disposed in the area of the ends of pole rods 4 which are provided with windings 6. Four pole rods 4 are provided, only two of them being visible in FIG. 1. Pole rods 4 extend within a space enclosed by means defining a substantially cylindrical radially magnetized permanent magnet 5, in a symmetrical arrangement and parallel to each other and to the longitudinal axis of the permanent magnet. The entire structure of the parts described is advantageously mounted in a housing (not shown).

Figure 2:
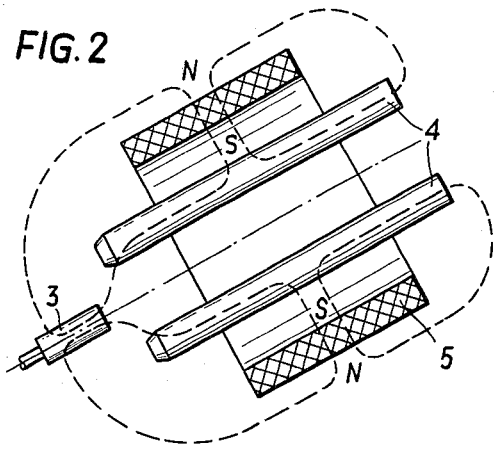
FIG. 2 shows the lines of force of the magnetic field.
Figure 3:
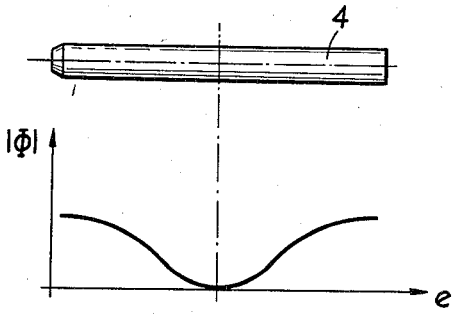
FIG. 3 shows the flux distribution along a pole rod (as a curve plotted below a pole rod)

FIG. 2 shows the lines of force in a sectional view corresponding to FIG. 1. It is evident that aside from the pole rods, no further flux conducting parts are needed in the inventive transducer. The magnetic flux is divided into two uni-directional fluxes, and, as shown in FIG. 3, is practically zero in the middle of the pole rods, while it attains its maxima at the ends. This effect is obtained by the radial magnetization of permanent magnet 5. It is clear that tube 3 of the inventive arrangement is securely magnetized up to the saturation range. However, it must be noted that the showings of FIGS. 1 and 2 are highly enlarged relative to the true scale and that the actual intermediate spaces to be bridged by the magnetic flux only amount to some tenths of a millimeter.

In the embodiment shown in FIG. 4, the transducer comprises, aside from the pole rods 4' with windings 3', means defining a substantially cylindrical permanent magnet assembled of four individual tube segments 5' which are identical with each other. These four individual elements may be cemented to each other at their contact faces, or they may be embedded in a body of plastic. It may easily be understood that a device for magnetizing the individual elements can be substantially simpler in construction than a device needed for magnetizing a tubular body. That is, it must be kept in mind that the dimensions of an electromagnetic transducer serving as a pickup for a plate-shaped record are very small, wherefore, the size of the magnetizing device cannot exceed a certain maximum so that the degree of magnetization is limited. With the inventive disaggregation of the permanent magnet 5 into individual elements, this difficulty is avoided, since the bar-shaped elements impose no requirements on the size of the magnetizing device. A single device rather is capable of simultaneously magnetizing a larger number of individual elements, which may substantially be considered as two-dimensional parts, as compared to three-dimensional bodies such as a tube where difficulties arise in the magnetization operation.

Figure 5:
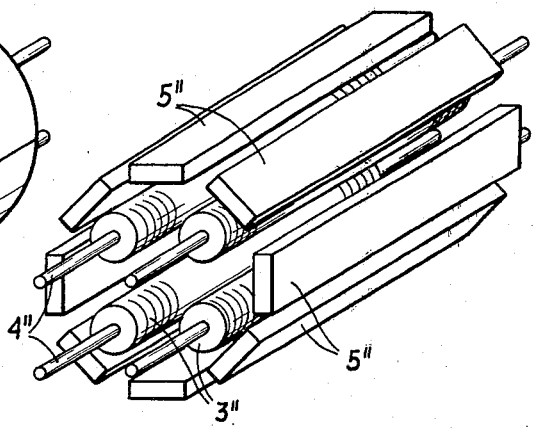
FIG. 5 shows an embodiment with a permanent magnet formed of individual, bar-shaped elements.

FIG. 5 shows an embodiment in which the means defining a substantially cylindrical permanent magnet is formed only by magnetic bars 5″ which extend parallel to the axis of pole rods 4″ and substantially enclose a cylindrical space. The gaps between the individual bars, which have a rectangular cross section, may be filled with a plastic, but it is also possible to use a body of plastic on, or in which, the bars are received.

Figure 7:
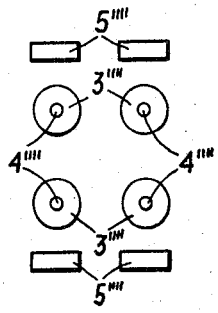
FIG. 7 shows another arrangement also with four bars.

Since modern magnetizable materials have an extraordinary high energy product, and values up to 26 megaoersted are attainable, the number of individual elements forming the permanent magnet can easily be reduced to four, as shown in FIGS. 6 and 7. In the embodiment of FIG. 6, the permanent magnet comprises four individual elements 5‴ which are disposed opposite each other and each associated with one pole rod 4‴. As long as the axes of the elements remain parallel to the axes of the pole rods and thus to the axis of the transducer, the individual bar elements may occupy any position relative to the respective associated pole rod, for example, the position shown in FIG. 7.

It is even possible to provide only two individual elements, as shown in FIG. 8. The two individual elements representing the permanent magnet have preferably the shape of tube segments 5⁗, however, they might also have the shape of a flat strip of iron. Each individual element is associated with adjacent pairs of pole rods 4⁗, and the two elements are disposed at opposite locations. In all of the embodiments it is possible, as already mentioned in connection with FIG. 2, to insert or engage the individual elements, embodied as bars, into a prefabricated transducer housing or casing which is provided with corresponding grooves or recesses, or the pole rods 4 along with the individual bars of permanent magnet 5 may be embedded in a thermoplastic material, with the pole rods and the magnets being closed at one end with plastic and the windings being inserted later. It is also possible to embed the individual elements alone in plastic, regardless of whether they have the shape of tube segments or flat bars, so that a tube with a closed cylindrical surface is produced, in the cavity of which the pole rods can be accommodated later.

The pole rods may be secured in the position shown in FIG. 8, by means of a simple molded plastic body. A still simpler way, however, is to fix the immovable parts of the inventive system by encapsulation in plastic. This completely prevents any natural vibrations of the pole rods, which may occur if they are fixed only by one end, for example, if they are anchored in a pole plate, is advantageous for the frequency response of the inventive transducer. The manufacture of the transducer is also definitely less expensive, as compared to conventional electromagnetic transducers, since it is assembled of only a small number of component parts.

While specific embodiments of the invention have been shown and described in detail to illustrate the application of the principles of the invention, it will be understood that the invention may be embodied otherwise without departing from such principles

What is claimed is:

1. An electromagnetic transducer for converting mechanically acoustic events into alternating voltages, particularly for tracing stereo signals produced on plate shaped supports, comprising:

four pole rods each having a coil winding therearound and having axes arranged substantially parallel and at corner points of a square lying in a plane perpendicular to said axes;

means defining a substantially cylindrical radially magnetized permanent magnet disposed around said four pole rods and elongated in the direction of said axes to extend over a substantial portion of said pole rods in the direction of said axes;

a pick-up stylus having a soft iron element driven by said pick-up stylus disposed adjacent one common end of said pole rods;

said permanent magnet means and said pole rods with said coil winding defining a transducer system having a central transducer system axis centrally of the axes of said pole rods;

mounting means mounting said pick-up stylus with soft iron element for universal pivotal movement about a center point located on said transducer system central axis;

said permanent magnet means having a first magnetic polarity adjacent an inner cylindrical surface thereof facing said pole rods and an opposite magnetic polarity adjacent an outer cylindrical surface thereof facing away from said pole rods, said magnetic means forming a transducer system magnetic circuit of magnetic flux lines through each of said pole rods from a vicinity of centers of each of said pole rods along said axes and outwardly of each of said pole rod centers;

said soft iron element being positioned so as to be directly included in said transducer system magnetic circuit at one end of said permanent magnet.

2. An electromagnetic transducer according to claim 1 wherein said means defining a substantially cylindrical radially magnetized permanent magnet comprises a plurality of bar elements disposed at spaced circumferential locations.

3. An electromagnetic transducer according to claim 2 wherein said bar elements comprise tube segments.

4. An electromagnetic transducer according to claim 2 wherein said bar elements have a rectangular cross section.

5. An electromagnetic transducer according to claim 1 wherein said means defining said substantially cylindrical radially magnetized permanent magnet comprises four circumferentially spaced bar elements, each being in close proximity to a respective one of said pole rods.

6. An electromagnetic transducer according to claim 11 wherein said means defining a substantially cylindrical radially magnetized permanent magnet comprises two oppositely disposed segments, each of which are associated with a respective pair of said pole rods.

7. An electromagnetic transducer according to claim 1 wherein said means defining a substantially cylindrical radially megnetized permanent magnet comprises a number of circumferentially spaced individual bar magnets at least as great as the number of said pole rods.

8. An electromagnetic transducer according to claim 7 wherein said permanent magnet rod members include a number greater than the number of said pole rods.

9. An electromagnetic transducer according to claim 1 wherein said means defining a substantially cylindrical radially magnetized permanent magnet includes a permanent magnet rod member disposed adjacent each respective pole rod, said rod member being at equally circumferentially spaced locations in respect to each other.

* * * * *